US007986912B2

(12) United States Patent
Maruyama

(10) Patent No.: US 7,986,912 B2
(45) Date of Patent: Jul. 26, 2011

(54) SHEET CONVEYANCE APPARATUS AND IMAGE FORMING APPARATUS WITH ROLLERS TO CORRECT SHEET MISALIGNMENT

(75) Inventor: Hiroyuki Maruyama, Sagamihara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 951 days.

(21) Appl. No.: 11/882,923

(22) Filed: Aug. 7, 2007

(65) Prior Publication Data

US 2008/0056790 A1 Mar. 6, 2008

(30) Foreign Application Priority Data

Sep. 4, 2006 (JP) ..... 2006-238798
Nov. 30, 2006 (JP) ..... 2006-323314
Nov. 30, 2006 (JP) ..... 2006-323317

(51) Int. Cl.
*G03G 15/00* (2006.01)

(52) U.S. Cl. ..... 399/394; 399/395; 399/396; 271/226; 271/227; 271/229

(58) Field of Classification Search ..... 399/395, 399/394, 396; 271/226, 184, 227, 229
See application file for complete search history.

(56) References Cited

U.S. PATENT DOCUMENTS 5,812,923 A * 9/1998 Yamauchi et al. ..... 399/388
6,866,260 B2 * 3/2005 Williams et al. ..... 271/227
7,210,682 B2 * 5/2007 Tsuzawa ..... 271/296
7,422,209 B2 * 9/2008 Hashimoto ..... 271/228

FOREIGN PATENT DOCUMENTS

JP 63-207670 8/1988
JP 04-028647 1/1992
JP 6-234441 8/1994
JP 8-268610 10/1996
JP 2000-335010 12/2000
JP 2005-35709 2/2005
JP 2006-027859 2/2006

* cited by examiner

*Primary Examiner* — Matthew G Marini
(74) *Attorney, Agent, or Firm* — Finnegan, Henderson, Farabow, Garrett & Dunner, L.L.P.

(57) ABSTRACT

A sheet conveying apparatus which conveys a recording sheet fed from a sheet feeding section toward a transfer position with controlled timing, including: a pair of registration rollers; a pair of loop rollers to form a loop of the recording sheet, the loop rollers being disposed upstream of the registration rollers in a sheet feeding direction; and a movable conveying unit configured such that the registration rollers and the loop rollers move as a unified body when correcting at least a lateral misalignment, which is a misalignment in a vertical direction to the sheet feeding direction, and inclination of the recording sheet.

24 Claims, 17 Drawing Sheets

SHEET CONVEYANCE APPARATUS AND IMAGE FORMING APPARATUS WITH ROLLERS TO CORRECT SHEET MISALIGNMENT

CROSS REFERENCE TO RELATED APPLICATION

This application is based on Japanese Patent Application No. 2006-238798, No. 2006-323314 and No. 2006-323317 respectively filed on Sep. 4, 2006, Nov. 30, 2006 and Nov. 30, 2006 with Japanese Patent Office, the entire content of which is hereby incorporated by reference.

BACKGROUND OF THE INVENTION

1. Field of Technology

This invention relates to conveyance technologies for accurately conducting sheet conveyance in an image forming apparatus.

2. Description of Related Art

In the image forming apparatus, an image is formed at a prescribed position on a sheet by transferring the sheet to an image forming position, namely to a transfer position by synchronizing the conveyance with the image formation.

The image forming apparatus and an image reading apparatus are required to accurately control and convey an original document and a sheet as a recording medium in terms of conveyance timing, the position in the conveyance and width direction, and inclination. However, since there are various kinds and characteristics of the sheets to be conveyed, and further, there are various kinds of environments, such as temperature and humidity in the conveyance, it is unavoidable that conveyance misalignment occurs.

With respect to the means for decreasing the position misalignment in the conveyance direction (vertical misalignment) and the inclination, in general, a technique for hitting the front edge of the sheet to a registration roller and for forming a sheet loop in the upstream of the registration roller has been generally utilized Further, technologies for correcting the conveyance misalignment have been developed.

For example, Japanese Patent Application Publication Open to Public Inspection No. S63-207670 (JPA63-207670) proposed a technique for detecting misalignment in the main scanning direction, namely the direction, which is perpendicular to the sheet conveyance direction, and correcting a write start poison in the main scanning direction based on the detected result in the print operation.

Japanese Patent Application Publication Open to Public Inspection No. H08-268610 (JPA08-268610) has proposed a technique of using a movable conveyance roller to be controlled its inclination to correct the lateral misalignment of a sheet based on the detected results of a sheet edge detection means.

Japanese Patent Application Publication Open to Public Inspection No. 2000-335010 (JPA2000-335010) has proposed a technique for determining a write position by detecting the sheet passage position in the main scanning direction (the direction, which is perpendicular to the sheet conveyance direction) as an absolute value based on the detected results by a sensor.

Japanese Patent Application Publication Open to Public Inspection No. 2000-35709 (JPA2000-35709) has proposed a technique for correcting slant sheet conveyance by revolving a pair of correction roller provided between two pairs of registration rollers around an axis, which is perpendicular to the conveyance direction, under the condition where the sheet is released from a nip of registration rollers and fastened by the correction rollers.

Japanese Patent Application Publication Open to Public Inspection No. H06-234441 (JPA06-234441) has proposed a registration apparatus for detecting a sheet inclination angle, swing a conveyance roller until the nip becomes parallel to the sheet front edge, nipping the sheet and further swing the conveyance roller so as to be perpendicular to the conveyance direction to convey the sheet when the sheet inclination angle is detected. Further, JPA06-234441 has proposed a technique for moving the conveyance roller in the thrust direction when lateral misalignment of the sheet exists.

In the high performance image forming apparatus, which is capable of forming a high quality image, such as a color image forming apparatus and a monochrome image forming apparatus used in a short-run printing field, those apparatuses are required to be accurate in the image position on the recording material. The required image position accuracy includes the accuracies of a vertical position, a lateral position and the inclination of the image.

On the other hand, in a high-speed apparatus, since the conveyance velocity of the recording medium is high, a minute timing shift causes a large misalignment of the image position. Further, when the recording material conveyance is not precisely conducted, inferior conveyance occurs, which causes image position misalignment and paper jam.

As described above, since the conditions for the conveyance of recording medium tend to become severe, the conventional conveyance technique becomes hard to conduct enough correction.

The technique for detecting conveyance misalignment and correcting the image writing position in the image writing operation, which was disclosed in JPA63-207670 and JPA2000-335010 cannot be used in the high-speed color image forming apparatus.

In the high-speed color image forming apparatus, a plurality of image forming sections is sequentially disposed along an image carrier. Since a plurality of monochromatic images is formed in the process, where the image carrier rotates through a revolution, it is inevitable that the distance from the first monochromatic writing position to the transfer poison of a multi-color image, onto which several monochromatic images are synthesized, becomes long. Thus, since write timing of the first monochromatic image becomes earlier than conveyance control timing of recording medium, the write position control based on the recording medium conveyance misalignment becomes impossible.

In the case when applying the correction technique disclosed in JPA63-207670 and JPA2000-335010 to the color image forming apparatus, the conveyance path of recording medium becomes very long. Thus, the conveyance misalignment occurs between a control position and an image transfer position and conveyance cannot be accurately conducted. Further, there is a problem that the size of the apparatus becomes large.

In the high quality image formation required in a POD (Print On Demand) market, a screen process is conducted. In this case, if the correction against the misalignment of a sheet inclination is conducted by adjusting the angle of the image, moiré occurs due to the relation between an adjusting angle and a screen angle. As a result, there is a problem that image quality becomes worse.

Since there is a problem when utilizing the techniques disclosed in JPA63-207670 and JPA08-268610 in the high-speed color image forming apparatus as described above, the technique for adjusting the misalignment by utilizing a loop or the techniques of misalignment adjustment, namely a techniques for adjusting the misalignment by shifting the conveyance roller in the shaft direction of the roller or revolving the shaft direction, which have been disclosed in JPA2000-335010 and JPA2005-35709 need to be used. However, it is difficult to adjust misalignment with high accuracy required in the POD field by applying these adjusting techniques. Image position misalignment, namely the misalignment of the image position from the designated position, which is positioned in a predetermined position against the sheet edge, becomes a problem.

In the case of the printer used in an office, where character images are mainly used, the misalignment in the degree of 1-2 mm will be acceptable. However, in the POD field, taking into account of imposition cutting and folio position, it is necessary to suppress the image position misalignment not more than 0.5 mm.

In the case when conducting misalignment adjustment by using a loop, which has been widely utilized, or conducting misalignment adjustment based on the shift of the conveyance roller in the shaft direction and revolution of the conveyance roller as disclosed in JPA2000-335010 and JPA2005-35709, the misalignment not less than 0.5 mm still resides and it is difficult to obtain satisfied quality. In order to satisfy the conditions previously described, extremely high parts accuracy is required and at the same time, durability will be lowered.

An object of the present invention is to form an image with high image position accuracy at the degree required by the POD field and to provide an image forming apparatus, which is capable of printing a high quality image.

SUMMARY

One aspect of the invention to attain the above described objects is a sheet conveying apparatus which conveys a sheet fed from a sheet feeding section toward a transfer position with controlled timing, including: a pair of registration rollers; a pair of loop rollers to form a loop of the recording sheet, the loop rollers being disposed upstream of the registration rollers in a sheet feeding direction; and a movable conveying unit configured such that the registration rollers and the loop rollers move as a unified body when correcting at least a lateral misalignment, which is a misalignment in a vertical direction to the sheet feeding direction, and inclination of the recording sheet.

The other aspect of the invention is an image forming apparatus including: an image carrier; an image forming section to form an image on the image carrier; a transfer section to transfer an image carried by the image carrier onto a recording sheet; and a sheet conveying apparatus which conveys a recording sheet toward a transfer position formed by the transfer section, wherein said sheet conveying apparatus is the above described sheet conveying apparatus.

The other aspect of the invention is the image forming apparatus described above, further including: a controller which controls timing of conveying the recording sheet toward the transfer position; and a detection section which detects the recording sheet passing through the sheet conveying apparatus, wherein the controller calculates vertical misalignment of the recording sheet, lateral misalignment of the recording sheet and inclination of the recording sheet based on a sheet detection signal of the detection section, and corrects at least the lateral misalignment and the inclination by controlling the movable conveying unit, where the vertical misalignment is a misalignment in the sheet feeding direction, and the lateral misalignment is a misalignments in a vertical direction to the sheet feeding direction.

Another aspect of the invention is the above-described image forming apparatus, wherein the controller initializes the movable conveying unit every time of formation of one frame image.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

The present invention will be described based on the embodiments illustrated in figures. However, this invention will not be limited to these embodiments.

Figure 1:
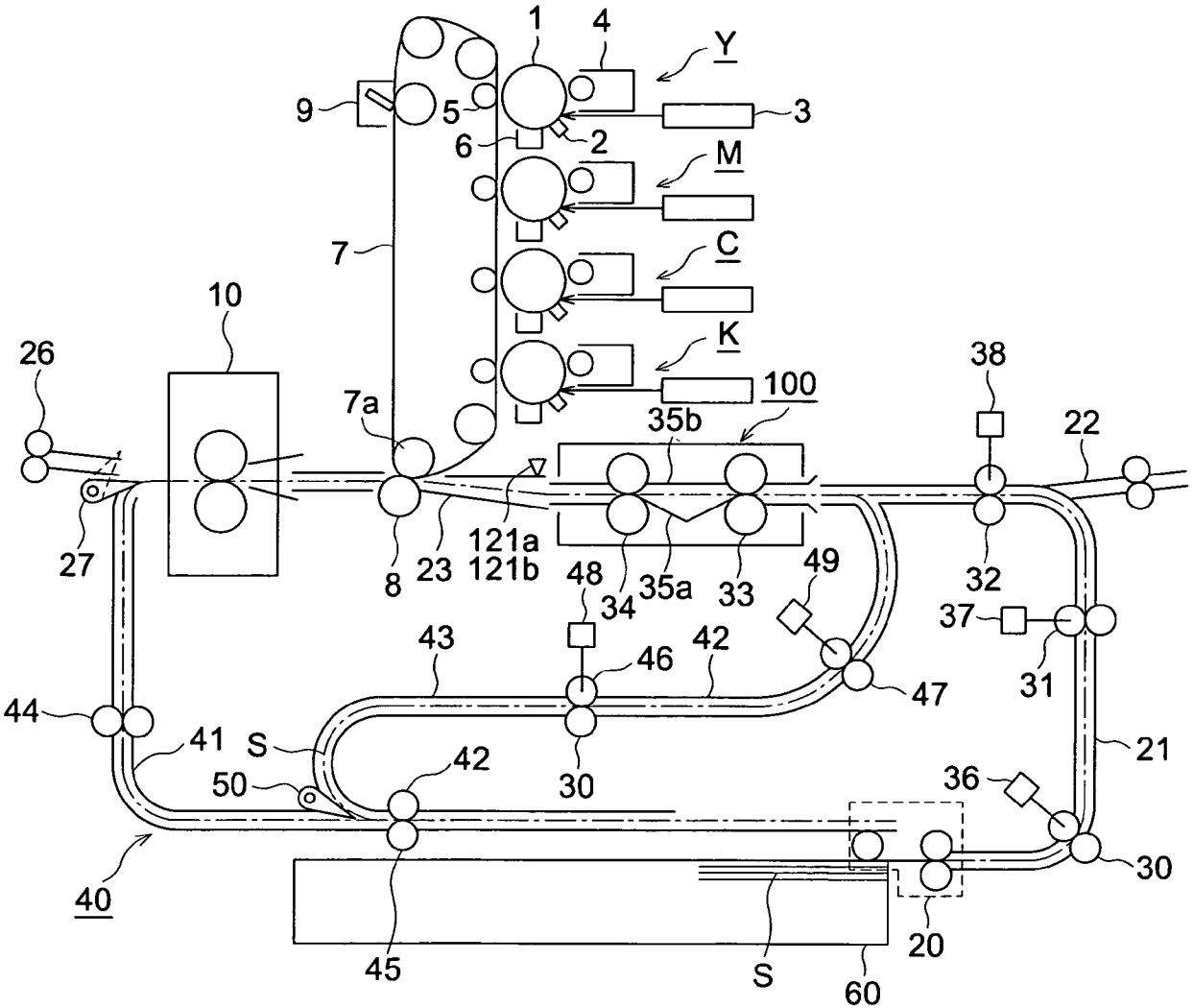
FIG. 1 illustrates a total configuration of an image forming apparatus of an embodiment of the present invention.

FIG. 1 illustrates a total configuration of an image forming apparatus of an embodiment of the present invention.

The image forming apparatus shown in FIG. 1 is an image forming apparatus of an embodiment of the present invention, which is capable of forming a color image. The image forming apparatus comprises an image forming unit Y for forming a yellow image, an image forming unit M for forming a magenta image, an image forming unit C for forming a cyan image and an image forming unit B for forming a black image. The image forming units Y, M, C and K respectively include a photoreceptor 1 having a drum shape, a charging apparatus 2, an exposing apparatus 3, a developing apparatus 4, a transfer apparatus 5 and a cleaning apparatus 6 to form a latent image onto a photosensitive material by charging and exposing operations and form a toner image onto a photoreceptor 1 by the developing apparatus 4.

The image forming units Y, M, C and K have the same structure. In the figure, numbers are placed only the parts of the yellow image forming unit and the numbers of the other image forming units will be omitted here.

The illustrated image forming apparatus is so to speak a digital image forming apparatus that emits light of a light source (for example a laser diode) in the exposing apparatus 3 based on image data and forms an image by exposing the photoreceptor 1.

Numeral 7 denotes an intermediate transfer material having a belt shape, which is trained about a plurality of rollers. Numeral 8 denotes a transfer apparatus for transferring a multi color image from the intermediate transfer material 7 (image carrier) onto sheet S. Numeral 9 denotes a cleaning apparatus for cleaning the intermediate transfer material 7.

The sheet S is stored in a sheet feeding tray 60. A sheet feeding unit 20 takes out a sheet S from the sheet feeding tray 60 one by one and conveys the sheet S to a transfer position formed by a transfer apparatus 8.

Numeral 10 denotes a fixing apparatus for fixing the image on a sheet S.

A conveyance path for conveying sheet S to the transfer position comprises conveyance paths 21, 22 and 23. A movable conveying unit 100 is disposed at a point where the conveyance path 21 joins the conveyance path 22.

Monochromatic images formed in the image forming units Y, M, C and K are transferred by the transfer apparatus 5 onto the intermediate transfer material 7. A multi color image is formed onto the intermediate transfer material 7 by superimposing the monochromatic images.

The transfer apparatus 8 transfers the multi color image on the intermediated transfer material 7 onto the sheet S fed from the sheet feeding tray 60.

The fixing apparatus 10 fixes the transferred multi color image onto the sheet S.

Cleaning apparatuses 6 and 9 respectively clean the photoreceptor 1 and intermediate transfer material 7 after image transferring.

Numeral 22 denotes a conveyance path for conveying the sheet S fed by a manual insertion operation to a transfer position.

A movable conveying unit 100 controls timing of the sheet S conveyed from a conveyance path 21 or a conveyance path 22 to the movable conveying unit 100 and feeds the sheet S to the transfer position.

Numeral 40 denotes a sheet re-feeding section for feeding the sheet S, on the front surface of which an image has been formed, to the transfer section again after reversing the sheet S in a dual surface image formation.

The sheet re-feeding section 40 is structured by a branch conveyance path 41 branched from a sheet ejection path, a reverse conveyance path 42 for reversing the sheet S and a sheet re-feeding path 43, through which the sheet S is re-fed to the transfer section.

Conveyance rollers 44 are provided on the branch conveyance path 41; conveyance roller 45 is provided on a reverse conveyance path; conveyance rollers 46 and 47 are provided on a sheet re-feeding path 43. Numeral 48 denotes a solenoid for forming/releasing nip of the conveyance roller 46. Numeral 49 denotes a solenoid for forming/releasing nip of the conveyance roller 47.

Numeral 27 denotes a switching gate for switching whether guiding the sheet S to an ejection roller 26 or to the sheet re-feeding section 40. Numeral 50 denotes a gate for introducing the sheet S from the branch conveyance path 41 to the reverse conveyance path 42 and at the same time guiding the sheet S from the reverse conveyance path 42 to the sheet re-feeding path 43.

Next, the movable conveying unit 100 will be described by referring to FIG. 2 onward.

Conveyance rollers 30, 31 and 32 for conveying the sheet S are provided on the conveyance path 21. Numerals 36, 37 and 38 denote solenoids respectively forming/releasing nip of the conveyance roller 30, nip of the conveyance roller 31 and nip of the conveyance roller 32.

The loop rollers 33 structured by a pair of rollers convey the sheet S conveyed from the conveyance path 21 or the conveyance path 22 to the registration rollers 34, which has been in a stop state. A pair of rollers, which nip and convey the sheet S, structures the registration rollers 34. Since the registration rollers 34 is in a stop state, the front edge of the sheet S to be conveyed is curved by the loop rollers 33 and a loop of the sheet S is formed. At the stage where a predetermined loop is formed, the conveyance of loop rollers 33 stops. The loop formation described above is conducted by a well-known method. For example, a reflection type sensor (not shown) provided at the passage position of the loop rollers 33 detects the front edge of sheet and stops the rotation of the loop rollers 33 after rotating the loop rollers 33 for a predetermined time period from the time when the front edge is detected. Based on this operation, a loop is formed.

A lower guide plate 35*a* of upper and lower guide plates 35*a* and 35*b* is curved as shown in FIG. 1 in order to allow the loop rollers 33 to form a loop.

After the loop formation, the registration rollers 34 are activated with controlled timing and convey the sheet S to the transfer position.

The loop formation controls the position of the sheet s so that the front edge of the sheet s becomes perpendicular to the conveyance direction.

The registration rollers 34 are activated in synchronizing with the image formation conducted in the image forming units Y, M, C and K and to convey the sheet S so that an image is formed at a predetermined position of the sheet S. Namely, an image formation start-signal in the sub-scanning direction (which corresponds to the conveyance direction of the sheet), which drives the exposing unit 3 of the image forming unit Y, which conducts the image formation first in the image forming units, is set as a reference point of time. The registration rollers 34 are activated after a predetermined time period has passed from the reference point of time described above.

The inclination of the sheet S is corrected to be perpendicular to the shaft of the registration rollers 34 by forming the loop in the upstream of the registration rollers 34. At the same time, the sheet S is conveyed in synchronizing with the image formation in the image forming unit based on the activation control of the registration rollers 34, which has bee described above. However, there is a case that, still minute misalignment of the sheet S resides even though such the conveyance control of the sheet S is conducted.

Namely, misalignment in the conveyance direction of sheet S (it will be called vertical misalignment), misalignment of the direction, which is perpendicular to the conveyance direction (it will be called the conveyance width direction misalignment) (it is also called lateral misalignment) and inclination of the sheet S reside. The sheet S having those misalignments is fed to the transfer position. Thus, there is a case that an image position is not accurate.

The misalignment, which cannot be corrected by utilizing the loop, will be corrected by using the fine adjustment described below.

Figure 2:
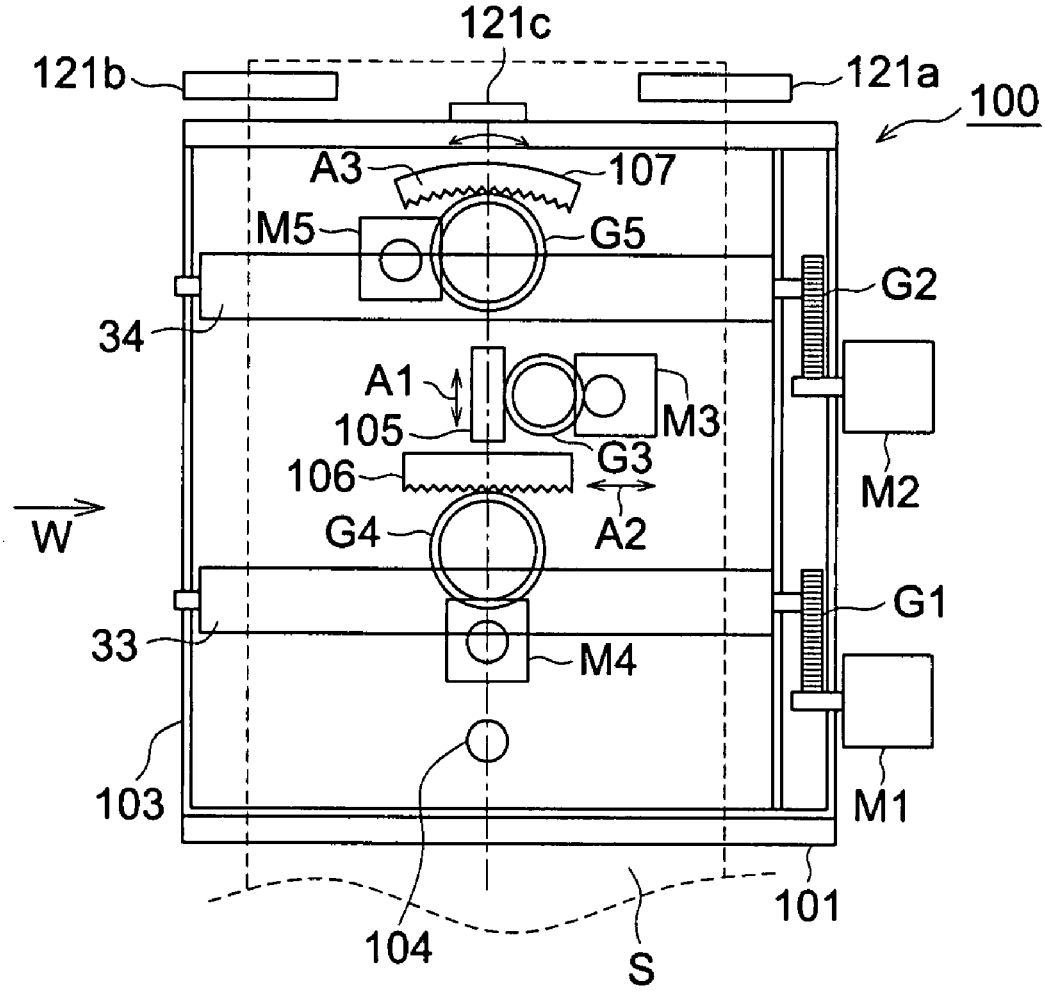
FIG. 2 illustrates a plan view of a movable conveying unit.
Figure 3:
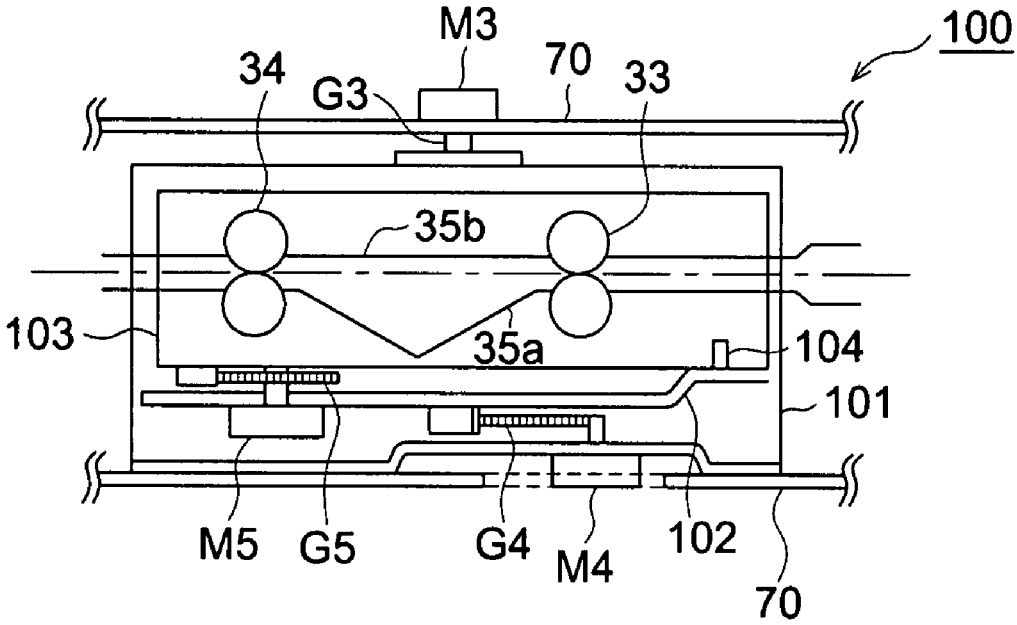
FIG. 3 illustrates a cross sectional view viewed from the W-direction of FIG. 2.

FIG. 2 illustrates a plan view of a movable conveying unit 100. FIG. 3 illustrates a cross sectional view of the movable conveying unit 100 viewed from the W-direction of FIG. 2.

The movable conveying unit 100 is attached to the main body frame 70 of the image forming apparatus and frames 101, 102 and 103 structure frameworks. These frames 101, 102 and 103 can relatively move each other as described below. Further, the frame 101 is an outmost frame, which can be capable of moving against the main body frame 70.

The loop rollers 33 and the registration rollers 34 are attached to the frame 103, which is an innermost frame as a first frame. A motor M1 drives and rotates the loop rollers 33 via a gear G1 to convey the sheet S. A motor M2 drives and rotates the registration rollers 34 via a gear G2 to convey the sheet S.

The movement of the frames 101-103 conducts the vertical misalignment correction, which is conveyance timing correction, the lateral misalignment, which is conveyance width direction misalignment correction, and the inclination correction, which is an inclination correction of the sheet on a conveyance surface, which will be described below.

The frame 101, which is an outmost frame as the third frame, is capable of moving in arrow directions A1, namely, in the conveyance direction of the sheet S. A rack 105 is fixed onto the frame 101. A motor M3 as a third drive section drives the rack 105 via a gear G3 to move the frame 101 in the arrow directions A1.

The frame 102 as a second frame is attached onto the frame 101 so as to be capable of moving against the frame 101. A rack 106 is fixed onto the frame 102. A motor M4 as a first drive section drives the frame 102 via a gear G4 and the rack 106 to move the frame 102 in the arrow directions A2, which are the conveyance width directions.

The frame 103 as a first frame is supported by a shaft 104 so as to be capable of moving against the frame 102. A partial gear 107 having teeth on an internal circumference is fixed onto the frame 103. A motor M5 as a second drive section drives the frame 103 via the partial gear 107 and a gear G5 to change the direction of the sheet S by rotating the frame 103 in an arrow directions A3 centering on the shaft 104, which is perpendicular to the sheet conveyance surface.

A stepping motor is used for the motors M1-M5. The motors M3-M5 rotate with a designated rotation amount in a positive direction or a reverse direction according to control signals.

Numerals 121*a* and 121*b* denote line sensors as a detection section for detecting sheet S conveyed from the registration rollers 34, which are configured by line CCDs and disposed right in a downstream of the registration rollers 34. Numeral 121*c* denotes an edge sensor for detecting sheet edge and outputs a trigger signal when reading the outputs of line sensors 121*a* and 121*b*.

Numerals 36-38 (refer to FIG. 1) denote solenoids as release devices for releasing the nips of conveyance rollers 30-32 disposed in an upstream of the movable conveying unit 100.

Figure 4:
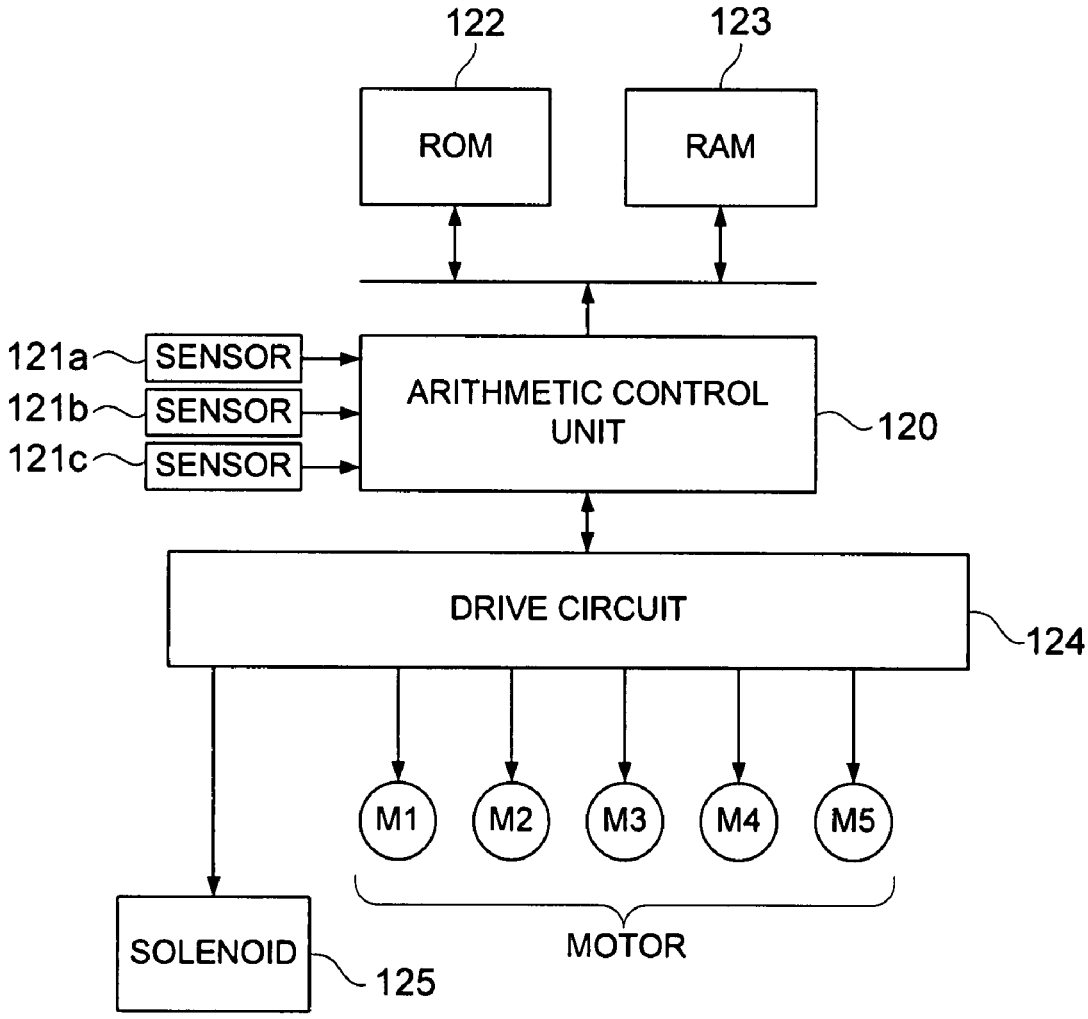
FIG. 4 illustrates a block diagram of a control system for controlling a sheet conveyance control.

FIG. 4 illustrates a block diagram of a control system for controlling a sheet conveyance control in the movable conveying unit 100.

Numeral 120 denotes an arithmetic control unit as a control section for conducting a sheet synchronizing conveyance control and misalignment correction, which is configured by a CPU; numerals 121*a* and 121*b* denote line sensors as shown in FIG. 2; numeral 121*c* denotes a front edge sensor for detecting the edge of sheet; numeral 122 denotes a ROM for storing a program; numeral 123 denotes a RAM, which is used for an arithmetic control conducted by an arithmetic control unit 120; and numeral 124 denotes a drive circuit for driving a solenoid 125 and motors M1-M5. The numeral 125 represents the solenoids 36-38, 48 and 49 illustrated in FIG. 1.

The conveyance of sheet S is conducted as following when an image is formed thereon.

The sheet S is outputted from the sheet feeding tray 60. The conveyance rollers 30-32, and the loop rollers 33 convey the sheet S. The front edge of the sheet S hits the registration rollers 34, which have been stopped. Then a loop of the sheet S is formed between the loop rollers 33 and the registration rollers 34. After the loop is formed, the registration rollers 34 are activated and convey the sheet S. The solenoids 125 operates and release the nips of the conveyance rollers 30-32 after a predetermined time period has passed from the point of time when the registration rollers 34 are activated.

Figure 5:
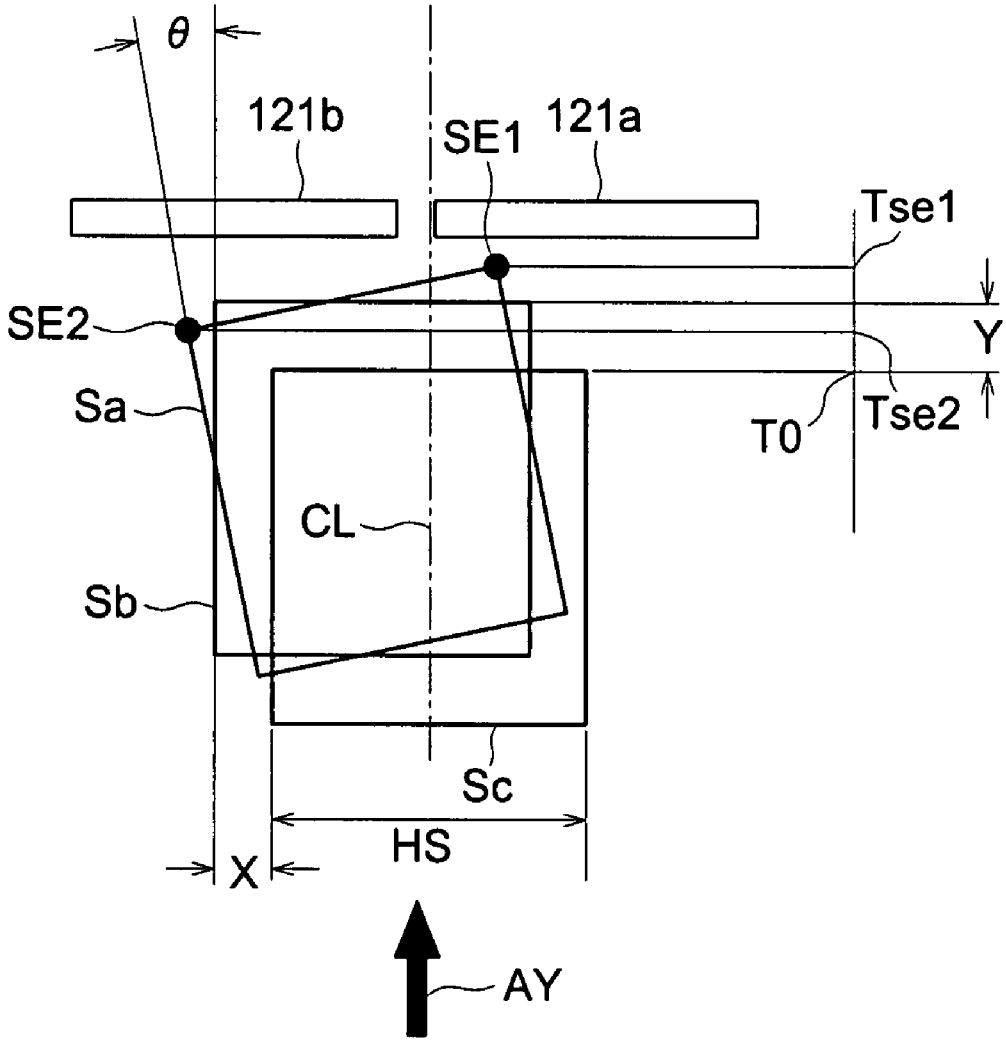
FIG. 5 illustrates misalignment of the sheet to be conveyed.

The arithmetic control unit 120 forming a control unit processes the detection signals of the line sensors 121*a*, 121*b* and 121*c* to calculate the vertical misalignment, the lateral misalignment and the inclination, and at the same time calculate the a pulse numbers, which are calculated correction amounts, from the calculated misalignments. The detection of the sheet S and the calculation based on the detection signals will be described by referring to the FIGS. 5 and 6. FIG. 5 illustrates misalignment of the sheet S conveyed by the registration rollers 34.

In FIG. 5, the vertical misalignment is expressed as a position misalignment of the sheet. However, the vertical misalignment is detected as a passage timing misalignment of the front edge of the sheet passing through the line sensors 121*a* and 121*b*. Thus, the sheet positions are expressed as detection timings, such as Tse1, Tse2 and T0.

As described above, the registration rollers 34 control the position of sheet S and convey the sheet S. However, still misalignment remains.

The sheet conveyed by the registration roller 34 is expressed by sheet Sa. The sheet Sa has misalignment as shown in the figure.

The sheet Sa is conveyed in the direction shown by an arrow AY. The front edges SE1 and SE2 of the sheet Sa are respectively detected by the line sensors 121*a* and 121*b*.

It becomes possible to take the length of a side of a triangle long, which is used for the inclination calculation when detecting the sheet inclination, by detecting the both edges of the conveyance width directions by using the line sensors 121*a* and 121*b*. Further, it becomes possible to make the detection error zero (0), which occurs when conducting the detection, by using only one side of the edge. Thus, a high accuracy correction becomes possible.

Figure 6:
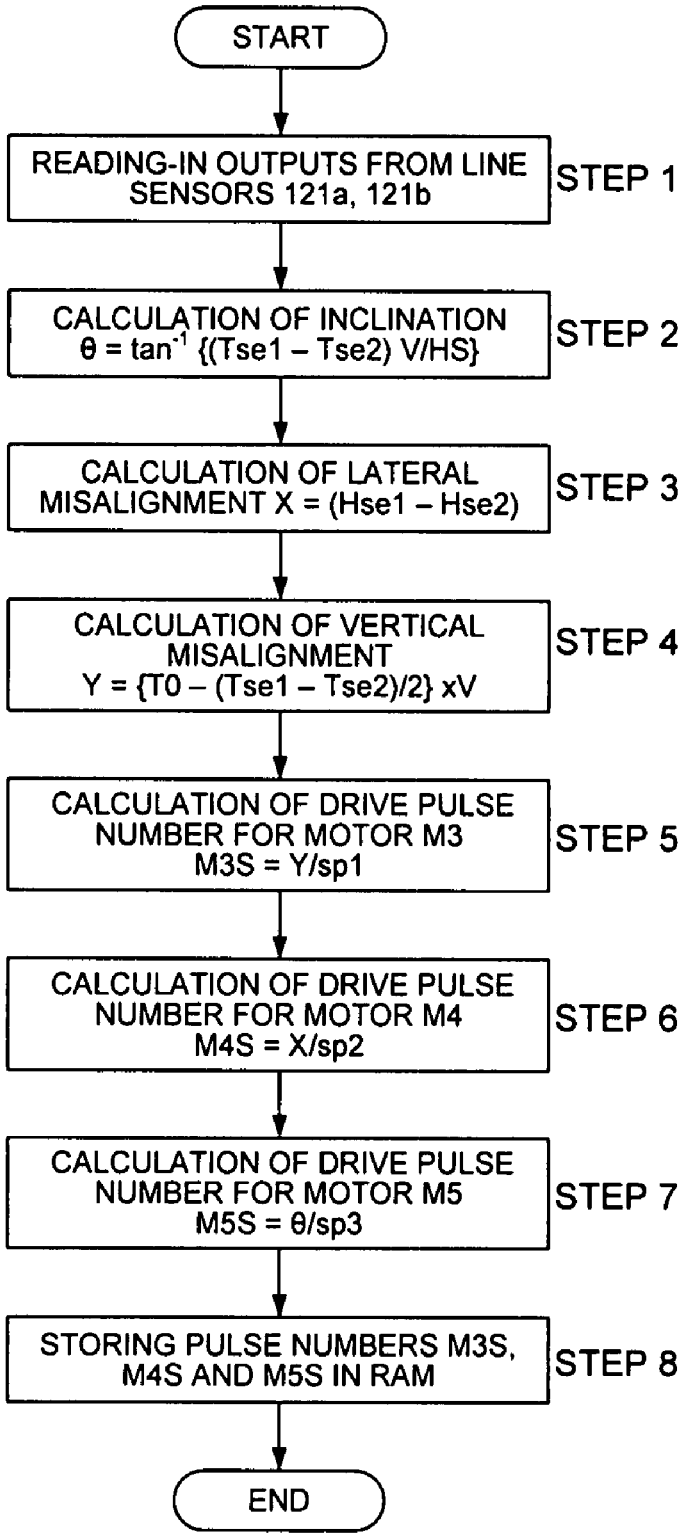
FIG. 6 illustrates a flowchart for explaining the calculation of correction amounts for vertical misalignment, lateral misalignment and inclination misalignment.

FIG. 6 illustrates an algorism for calculating a correction amount against the vertical misalignment Y, the lateral misalignment X and inclination θ.

At STEP 1, the outputs of line sensors 121*a* and 121*b* are read in. This read-in operation is triggered by the output signal of the front edge sensor 121*c*.

At STEP 2, the inclination θ is calculated.

The inclination θ is calculated by a following formula (1).

$$\theta=\tan^{-1}((Tse1-Tse2)V/HS) \quad (1)$$

Where Tse1 denotes the detected timing of the front edge SE1; and Tse2 denotes the detected timing of the front edge SE2; V denotes the velocity of sheet S.

A width HS of sheet S can be obtained based on the sheet size information. However, the width HS of sheet S can also be obtained by the distance of the positions between signal-output pixels of the line sensors 121*a* and 121*b*.

HS denotes the width of sheet S (the sheet length in the direction, which is perpendicular to the conveyance direction). In FIG. 5, the timing difference of the front edges of the sheet S detected by the line sensors 121*a* and 121*b* is expressed as a position difference. The passing timing of the front edges of sheets Sa, Sb and Sc passing through the line sensors 121*a* and 121*b* correspond to the position differences shown in FIG. 5.

Detecting the inclination θ makes it possible to predict the inclination corrected sheet Sb.

The lateral misalignment X and the vertical misalignment Y can be detected by comparing the sheet Sb with the reference sheet Sc.

The reference sheet Sc is set based on the timing of the image formation start signal in the sub-scanning direction (the direction corresponding to the conveyance direction of the sheet S) of the exposing apparatus 3 in the image forming unit Y and the sheet size information.

Namely, the passing timing T0, at which the front edge of the sheet Sc passes through the line sensors 121*a* and 121*b*, is determined by adding a predetermined time period to the output timing of the image formation start signal.

At STEP 3, the lateral misalignment X can be calculated by the following formula (2).

$$X=(Hse1+Hse2)/2 \quad (2)$$

Where Hse1 denotes a width direction position of the left side of the sheet Sb and the Hse2 denotes a width direction position of the right side of the sheet Sb in FIG. 5. Here, these output positions are the distances from a centerline CL. For example, the position of the centerline CL is set to be zero (0), and the right direction of the center line CL is set to be positive and the left direction of the center line CL is set to be negative value.

In STEP 4, the vertical misalignment Y is calculated by following formula (3).

$$Y=(T0-(Tse1+Tse2)/2)\times V \quad (3)$$

In step 5, a drive pulse number M3S for driving the motor M3 is determined from the vertical misalignment amount Y; in STEP 6, a drive pulse number for driving the motor M4S is determined from the lateral misalignment amount X1; and in STEP 7, a drive pulse number M5S for driving the motor M5 is determined from the inclination θ. The pulse numbers M3S, M4S and M5S include signal whether rotating motors M3-M5 in a positive rotation or a reverse rotation.

The pulse numbers M3S, M4S and M5S can be calculated by following formulas.

$$M3S=Y/sp1,$$

$$M4S=X/sp2 \text{ and}$$

$$M5S=\theta/sp3$$

Where sp1 denotes a distance, which the frame 101 moves based on a pulse drive of the motor M3. Sp2 denotes a distance, which the frame 102 moves based on a pulse drive of the motor M4. Sp3 denotes an angle, which the frame 103 rotates based on a pulse drive of the motor M5.

The pulse numbers M3S, M4S and M5S determined in STEP 8 are stored in a RAM 123.

Figure 7:
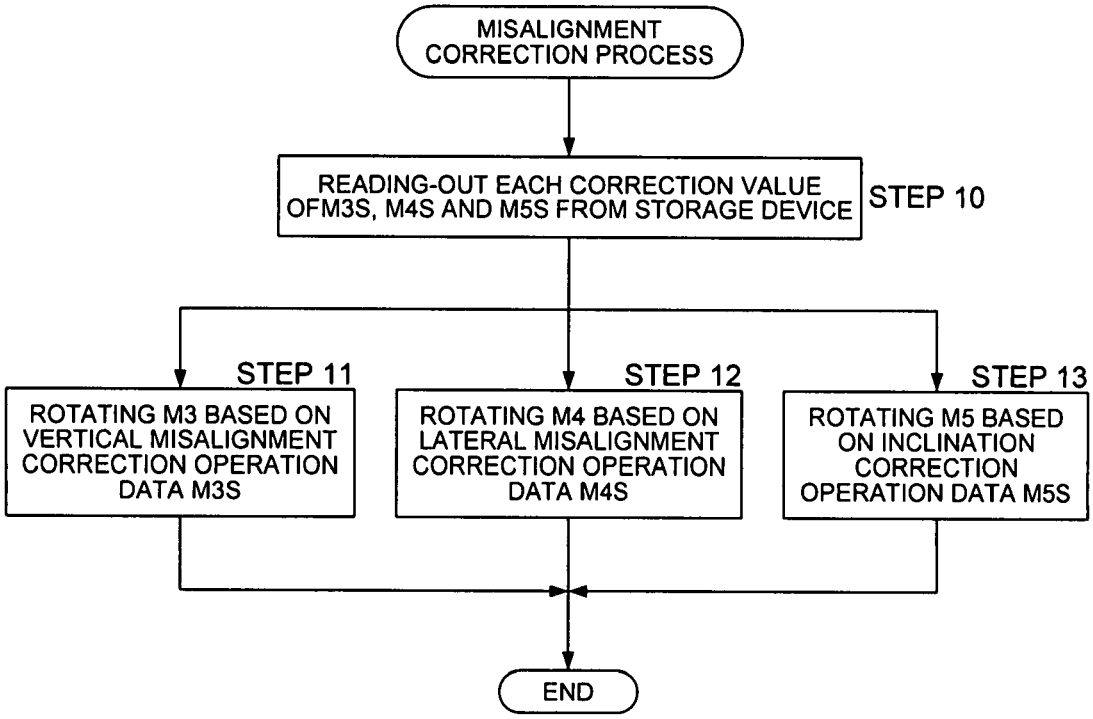
FIG. 7 illustrates a flowchart for misalignment correction.

FIG. 7 is a flowchart for misalignment correction.

The arithmetic control unit 120 reads out the pulse numbers M3S, M4S and M5S from the RAM 123, drives the motor M3 by applying the pulse M3S to correct the vertical misalignment (STEP 11), drives the motor M4 by applying the pulse M4S to correct the lateral misalignment (STEP 12), and drives the motor M5 by applying the pulse M5S to correct the inclination (STEP 13). As described above, the pulse numbers M3S, M4S and M5S include signal whether rotating motors M3-M5 in a positive rotation or a reverse rotation, and the arithmetic control unit 120 rotates the motors M3-M5 in a determined direction based on the determined pulse number.

The STEPS 11-13 are executed at the same time and the motor-drives of M3-M5 are instantaneously conducted.

Figure 8:
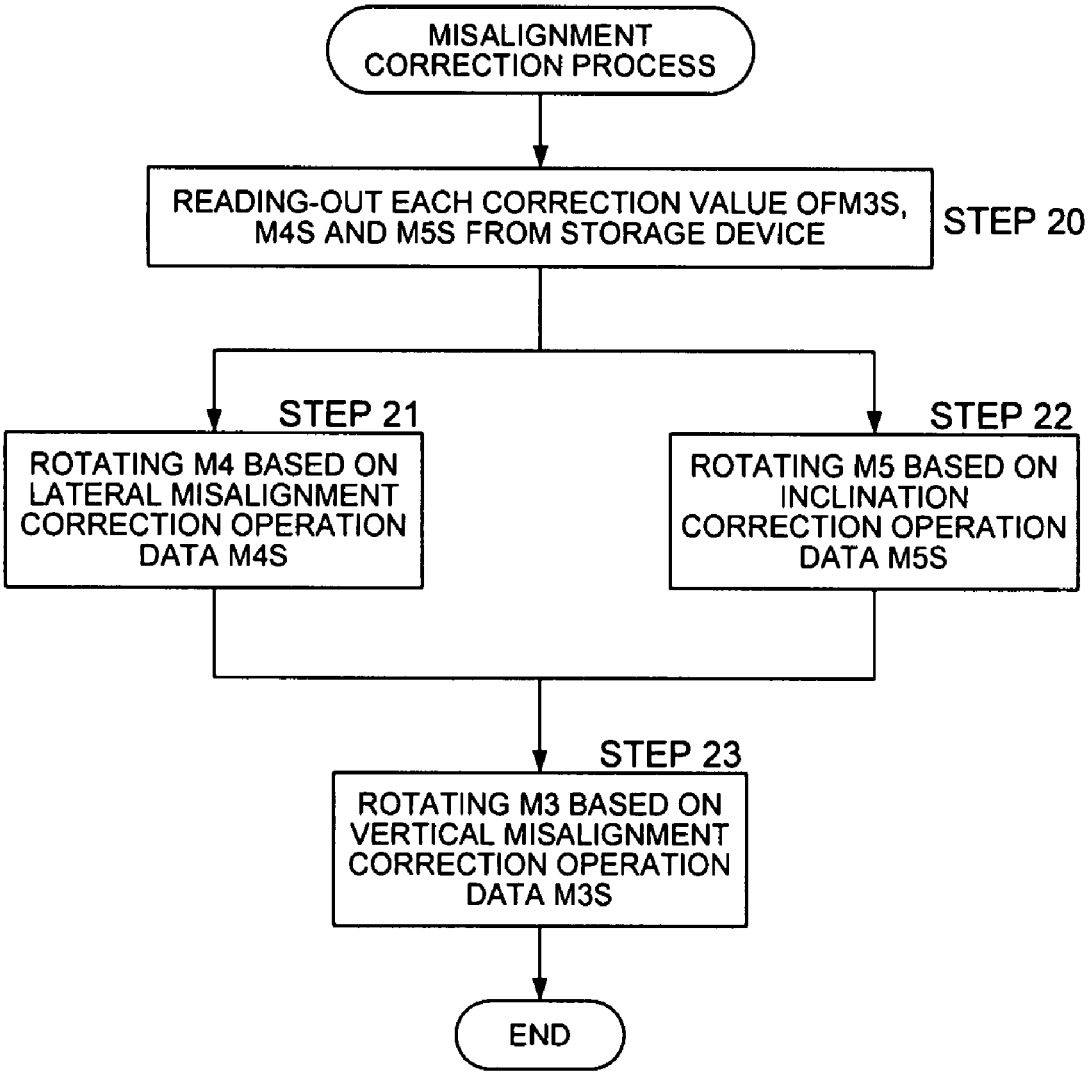
FIG. 8 illustrates other example of the flowchart for misalignment correction.

The misalignment correction can also be conducted by the sequence shown in FIG. 8.

As shown in FIG. 8, after reading out the pulse numbers in STEP 20, the motors M4 and M5 respectively correct the lateral misalignment and the inclination in steps 21 and 22. Then the motor M3 corrects the vertical misalignment.

Figure 9:
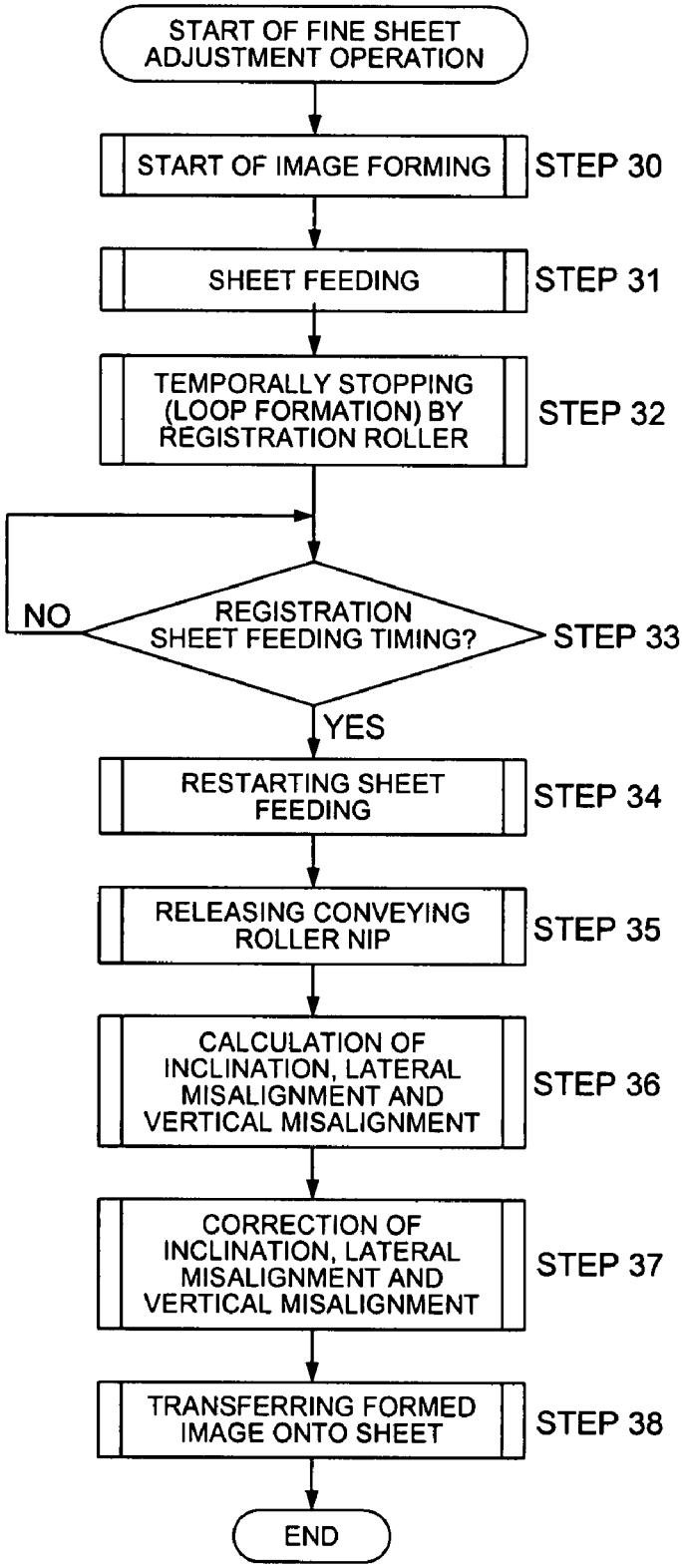
FIG. 9 illustrates a flowchart for an image forming process.

An image forming process including the detections of the vertical misalignment, the lateral misalignment and the inclination, and the correction for these misalignments, which have been described by using FIGS. 5-8, is conducted as illustrated in FIG. 9.

In STEP 30, image formation start. The image formation means the exposure by the exposing apparatus 3 of the image forming units Y, M, C and K in FIG. 1.

In STEP 31, the sheet feeding unit 20 starts sheet feeding and sheet S is conveyed to the registration rollers 34.

In STEP 32, a loop of the sheet S is formed in the upstream of the registration rollers 34. The loop is formed by rotating the loop rollers 33 to be stopped when a predetermined time period has passed after a sheet line sensor (not shown) provided right in the downstream of the loop rollers 33 detects the sheet front edge.

The front edge of the sheet S is controlled to be parallel to the shaft direction of the registration rollers 34 by this loop formation.

In STEP 33, the lapse of a predetermined time from the image formation start described in the STEP 30 is detected. At the lapse of the predetermined time, the registration rollers 34 are activated to restart the conveyance of the sheet S in STEP 34.

In STEP 35, after a predetermined time period from the conveyance start of the sheet S by the registration rollers 34 at the STEP 34, a solenoid 125 (refer to FIG. 4) is driven to release the nips of the conveyance rollers 30-32.

The line sensors 121*a* and 121*b* detect the front edge of the sheet S conveyed by the registration rollers 34. In STEP 36, the vertical misalignment, the lateral misalignment and the inclination based on detection signals of the line sensors 121*a* and 121*b* will be calculated.

In STEP 37, the misalignment corrections determined by the calculations will be conducted. The calculations and the corrections of misalignment will be conducted as described above.

In STEP 38, a transfer apparatus 8 conducts transfer operation.

After forming the loop and correcting the vertical misalignment and the inclination as described above, by further conducting adjustments based on the sheet detection signals of the line sensors 121*a* and 121*b*, the image front edge can be coincident with the sheet front edge with extremely high accuracy at the transfer position.

In the case of dual surface image formation, after conveying the sheet S to the transfer section after having finished the misalignment corrections described above, the sheet S, to which the fixing process has been applied, is conveyed to the sheet re-feeing section 40.

The sheet S is turned upside down by the sheet re-feeding section 40 and conveyed to the movable conveying unit 100.

The line sensors 121 detect the vertical misalignment, the lateral misalignment and inclination of the sheet and an adjustment control is conducted based on the detected results. In this case, the nips of conveyance rollers 46 and 47 located in a sheet re-feeding path 42 are released by a solenoid 125 (48 and 49).

By the misalignment correction in the dual surface image formation, the misalignment between the front surface image and the rear surface image will be corrected with a high accuracy.

The movable conveying unit 100 (refer to FIGS. 1-2) is adjusted for the misalignment correction and the frames 101-103 of the movable conveying unit 100 (refer to FIGS. 2-3) are arranged to respectively move in the sheet conveyance direction and sheet width direction, and rotate. The frames 101-103 are initialized in every sheet conveyance corresponding to every frame image formation.

Concretely, the movable conveying unit 100 is initialized at the timing after the rear edge of the sheet S has passed through the registration rollers 34 or the front edge sensor 121 C, and before the front edge of the next sheet S enters the loop rollers 33.

Figure 10:
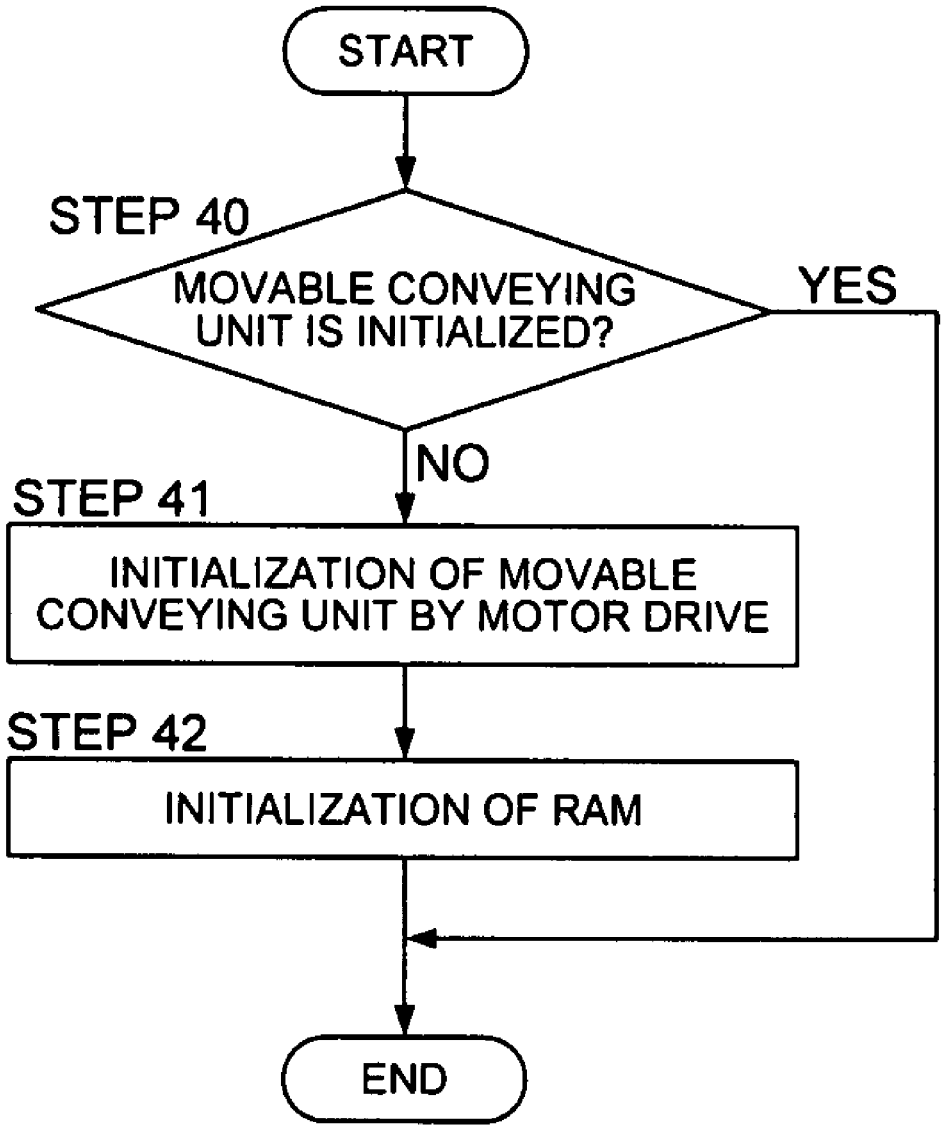
FIG. 10 illustrates a flowchart of a process for initializing the movable conveying unit.

FIG. 10 illustrates the flowchart of the process for initializing the movable conveying unit 100.

The arithmetic control unit 120 checks whether the movable conveying unit 100 has been initialized in STEP 40. The check operation in STEP 40 is conducted by checking whether the pulse numbers M3S, M4S and M5S has been reset to 0 (zero).

When the pulse numbers M3S, M4S and M5S are reset to 0 (zero) (STEP 40: YES), the process moves to END. When the pulse numbers M3S, M4S and M5S are not reset to 0, move the frames 101-103 in an opposite direction for distances corresponding to the pulse numbers M3S, M4S and M5S. Namely, in FIGS. 7 and 8, the motors M3-M5 have been driven for the periods corresponding to the pulse numbers M3S, M4S and M5S. However, in STEP 41 in FIG. 10, the motors M3-M5 are driven for the periods corresponding to the pulse numbers −M3S, −M4S and −M5S.

Based on this operation, the frames 101-103 return to the initial positions and the movable conveying unit 100 is initialized.

Following to the initialization of the movable conveying unit 100, in STEP 42, data in the RAM 103, namely M3S, M4S and M5S are initialized to 0 (Zero).

With respect to the initialization of the movable conveyance unit 100, it is also possible to use the following method of returning the frames 101-103 to the initial positions. By providing home position sensors for detecting initial positions of frames 101-103 on the frames 101-103; checking whether the frames 101-103 are initialized by the output of the home position sensors; and moving the frames 101-103 as monitoring the outputs of the home position sensors to return them to the initial positions.

Figure 11:
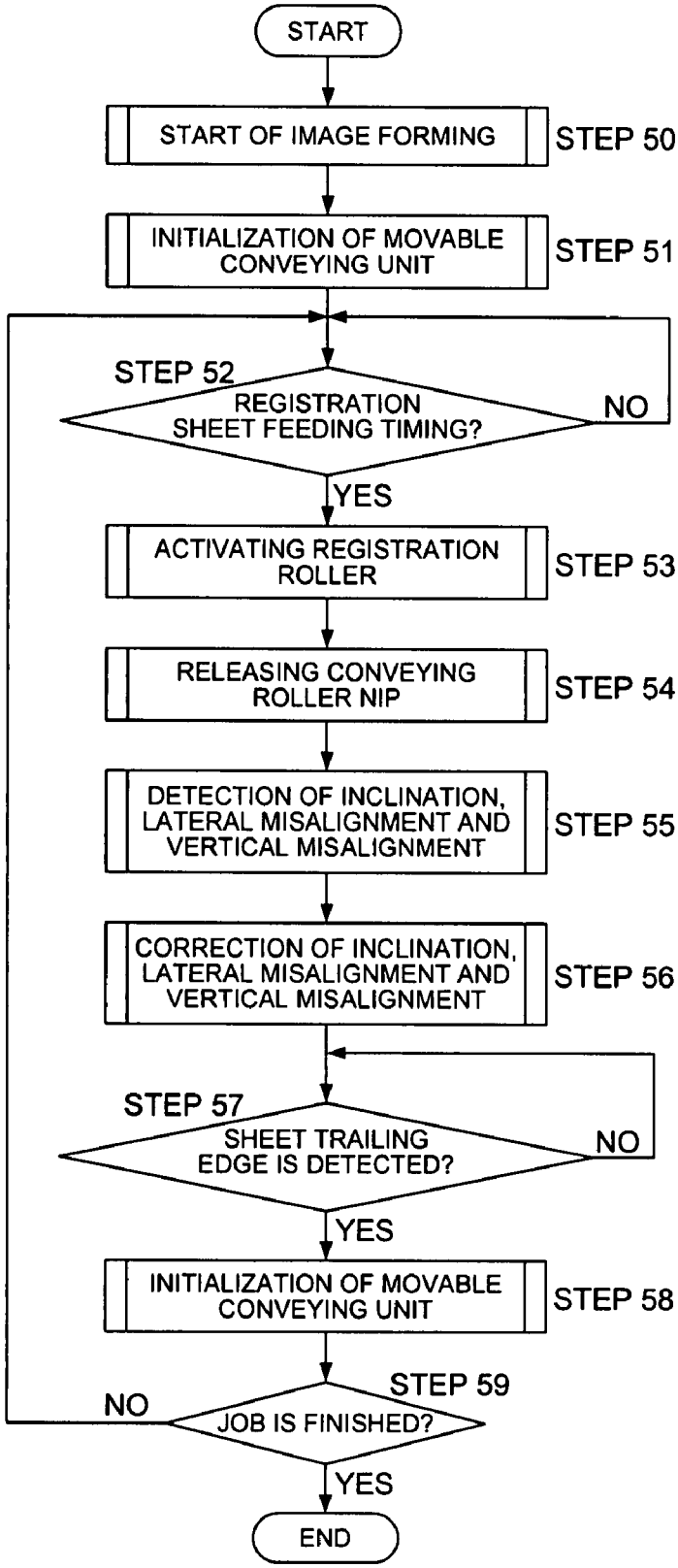
FIG. 11 illustrates a flowchart of a conveyance control in the conveyance of a registration roller.

The detection of the vertical misalignment, the lateral alignment and the inclination, and their corrections, which have been described by using FIGS. 5-8, in addition to these, the sheet conveyance by the registration rollers 34 including the initialization operation shown in FIG. 10 will be executed as shown in FIG. 11.

In STEP 50, an image formation is arranged to start. The image formation starts based on a copy button being turned on or the drive of the image forming units Y, M, C and K shown in FIG. 1 based on the print instruction from an external apparatus.

Following the image formation start (STEP 50), the movable conveying unit 100 is initialized (STEP 51). The initialization is executed as illustrated in FIG. 10.

In STEP 52, the arithmetic control unit 120 detects the predetermined time period from the image formation start. In STEP 53 the arithmetic control unit 120 activates the registration rollers 34 to convey the sheet S after the predetermined time period has passed.

The predetermined time period for determining the point of time to activate the registration rollers 34 is counted from the exposure start of the exposing apparatus 3 of the image forming unit Y, which firstly conducts image formation.

A sheet S has been conveyed to the registration rollers 34, from the conveyance section in the upstream of the registration roller 34. The loop roller 33 has formed a loop of the sheet S in the upstream of the registration rollers 34.

In STEP 53, the arithmetic control unit 120 drives a solenoid 125 (refer to FIG. 4) after the predetermined time period has passed from the start of sheet S conveyance by the registration rollers 34, and releases the nips of the conveyance rollers 30-32 (STEP 54).

The line sensors 121*a* and 121*b* detect the front edge of the sheet S conveyed by the registration rollers 34. In STEP 55, the arithmetic control unit 120 calculates the vertical misalignment, the lateral misalignment and the inclination based on the detected signals of the line sensors 121*a* and 121*b*.

In STEP 56, the misalignment correction, which has been determined by the calculation, is conducted. The misalignment calculation and correction are conducted as described above.

In STEP 57, the sensor 121*c* monitors the rear edge of the sheet S. When having detected the rear edge of the sheet S (in STEP 57: Yes), the arithmetic control unit 120 initializes the movable conveyance unit 10 illustrated in FIG. 10 (STEP 58).

After completing the initialization of the movable conveying unit 100, when a job has finished, the arithmetic control unit 120 finishes the conveyance control. When the job has not finished, the process returns to the activation step of the registration rollers 34 (STEP 52).

In the dual surface image formation, after having conveyed the sheet S to the transfer section and formed a surface image after completing the misalignment correction described above, the sheet S, onto which an image has been fixed, is conveyed the sheet re-feeding section 40.

After the sheet S has been reversed upside down in the sheet re-feeding section 40, the sheet S is conveyed to the movable conveying unit 100. The line sensors 121*a* and 121*b* detect vertical misalignment, lateral misalignment and inclination of a sheet. Then the adjustment control is conducted based on the detected results. In this case, the solenoid 125 releases nips of conveyance rollers 46 and 47 arranged in the sheet re-feeding path 42.

The conveyance control shown in FIG. 11 is conducted not only to the front surface image formation but also to the rear surface image formation in the conveyance control of the registration rollers 34 in the dual surface image formation the same as the conveyance control in the singe surface image formation. When re-feeding the sheet, onto the front surface of which an image has been formed, the movable conveying unit 100 is initialized and the misalignment correction is executed after the initialization.

Based on the misalignment correction in the dual surface image formation described above, misalignment between the front surface image and the rear surface image can be corrected with high-accuracy.

Figure 12:
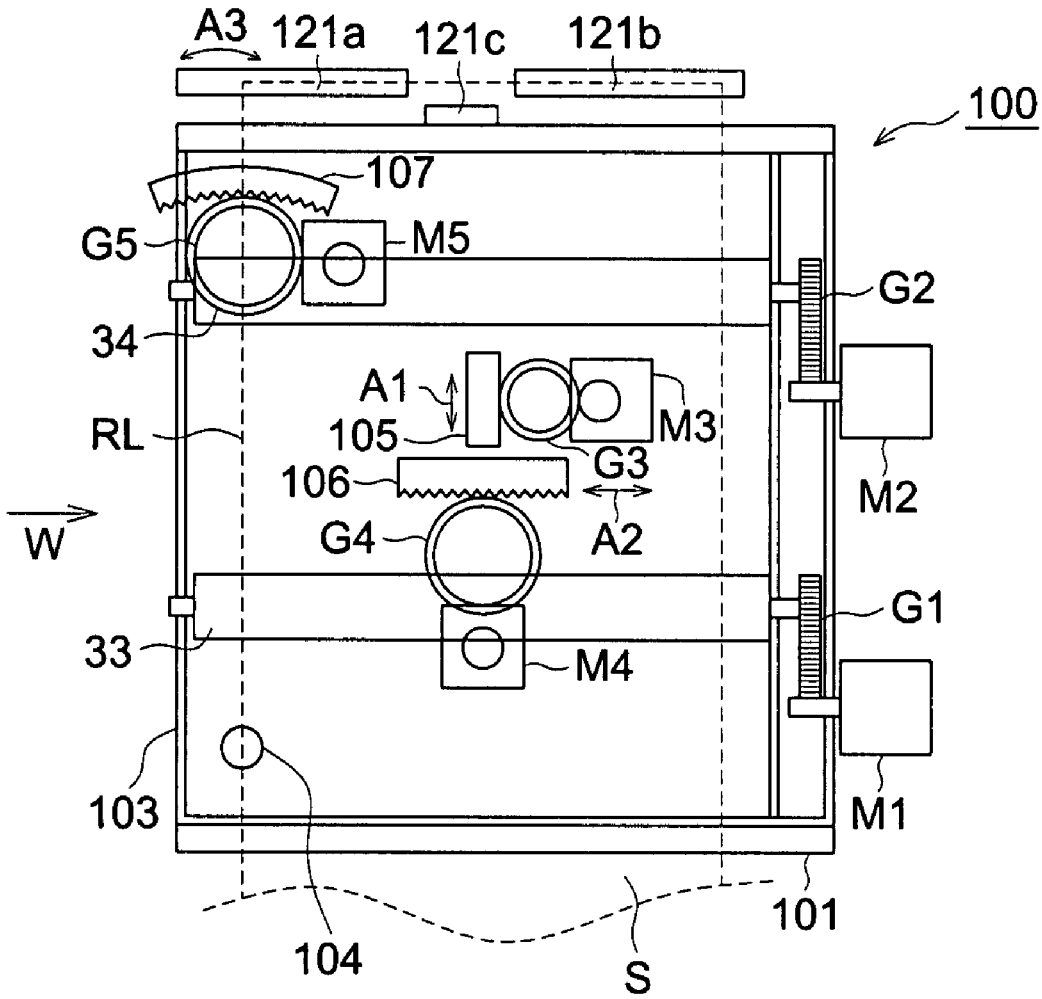
FIG. 12 illustrates other example of a movable conveying unit in the image forming apparatus of an embodiment of the present invention, namely a plan view of the movable conveying unit in a one-side reference conveyance system.

FIG. 12 illustrates other example of a movable unit in the image forming apparatus of an embodiment of the present invention.

The example described in FIGS. 1-11 employs a sheet conveyance system referring to the center thereof, namely it is a misalignment correction in the conveyance system where the sheet is conveyed so as to coincide the centerline of sheets having various sheet sizes to the centerline. However, this invention can be applied to a sheet conveyance system of one side reference, namely this invention can be applied to the conveyance system for conveying sheets having various kinds of sizes so as to coincide a side of the sheets to one side, which is parallel to the conveyance direction.

FIG. 12 illustrates other example of a movable conveying unit in the image forming apparatus of an embodiment of the present invention, namely a plan view of the movable conveying unit 100 in a one-side reference conveyance system.

The same symbol is put on the respective parts in FIG. 12, which are the same parts in FIG. 2.

In FIG. 12, the frame 103 is attached to the frame 102 so as to be capable of being rotated centering on a shaft 104 provided on a reference line RL in the sheet conveyance. Sheets having all sizes are conveyed so that the one of side of the sheet coincides to the reference line RL of sheet.

An axis of gear G5 driven by the motor M5 is also provided on the reference line RL, and the gear 5 is arranged to engage with the partial gear 107.

The frame 103 rotates centering on the shaft 104 on the reference line RL to correct the inclination e based on the drive of the motor 5.

In the lateral misalignment correction of the one-side reference conveyance, conducted is a correction operation where the side edge of the sheet, to which the inclination correction has been executed, (which corresponds to Sb in FIG. 5) is arranged to coincide with the reference line RL.

Figure 13:
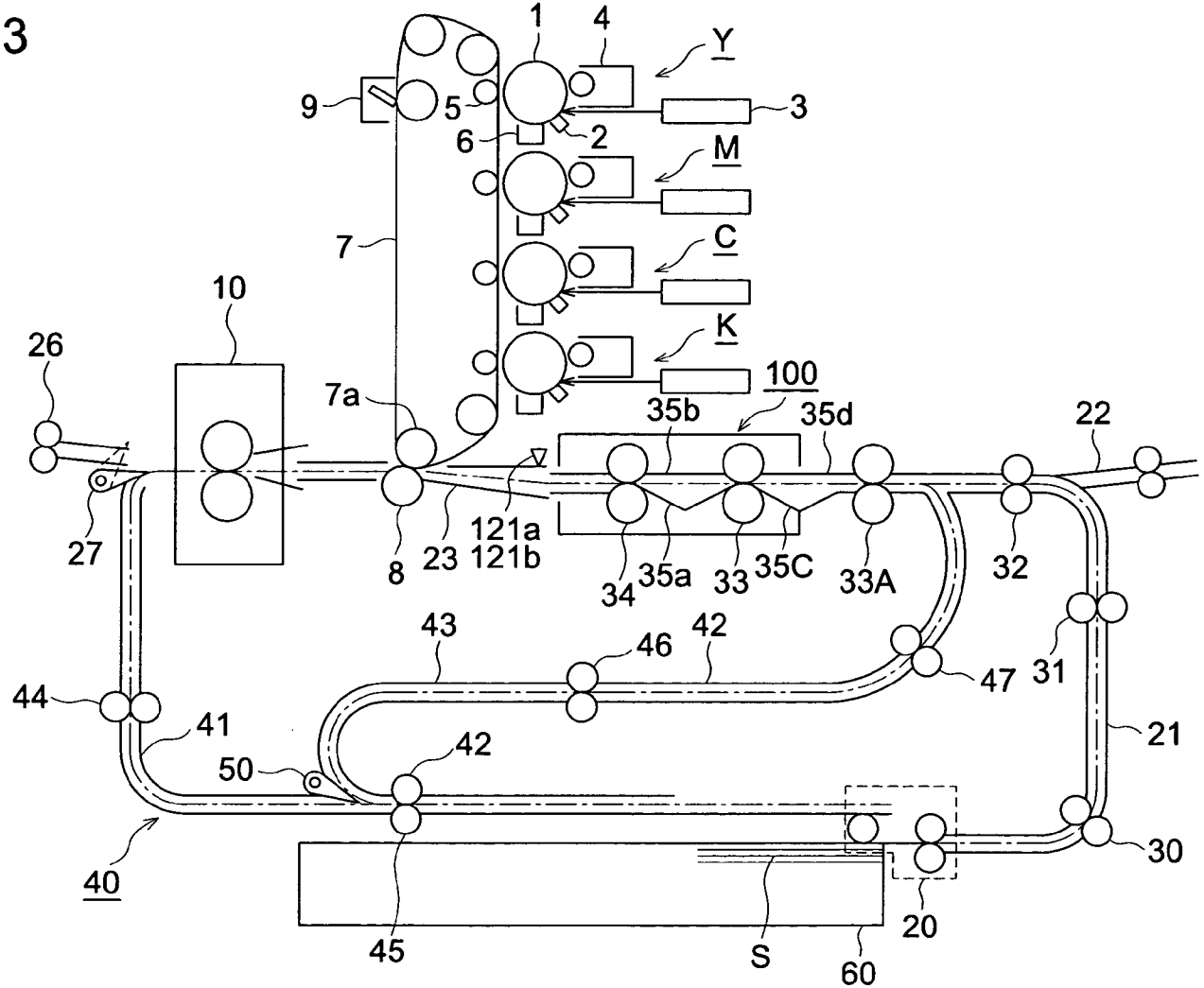
FIG. 13 illustrates a total configuration of the other example of the image forming apparatus of an embodiment of the present invention.

FIG. 13 illustrates a total configuration of the other example of the image forming apparatus of an embodiment of the present invention.

In this example, by forming a sheet loop in the upstream of the movable conveying unit 100 (it will be called a preceding step loop), misalignment correction becomes possible without releasing nips of conveyance rollers in the upstream of the movable conveying unit 100.

In FIG. 13, numeric character 33A denotes loop rollers as a loop forming section for forming a preceding step loop in the upstream of the loop rollers 33, namely in the upstream of the movable conveying unit 100. In the example shown in FIG. 1, the solenoids 36-38 release the nips of the conveyance rollers 30-32. However, in this example, the release of the nips of the conveyance rollers 30-32 is not conducted.

Numeric character 35*c* denotes a curved guide plate, which enables the preceding step loop formation. Numeric character 35*d* denotes a flat shaped guide plate.

In the example of FIG. 13, the loop rollers 33A conveys the sheet S toward the loop rollers 33, which have been stopped. When a loop of the sheet S has been formed in the upstream of the loop rollers 33, the loop rollers 33 starts rotating and conveys the sheet S toward the registration rollers 34, which have been stopped.

When a loop has been formed in the upstream of the registration rollers 34, the registration rollers 34 start rotating and conveys the sheet S.

As described above, the vertical misalignment correction, the lateral misalignment correction and the inclination correction of the movable conveying unit 100 are conducted. Since the loop is formed in the upstream of the movable conveying unit 100, namely the loop is formed between the loop rollers 33A and the loop roller 33, the misalignment can be corrected without releasing the nips of the conveyance rollers provided in the upstream.

The image forming apparatus shown in FIG. 13 has the same structure of the image forming apparatus shown in FIGS. 1-3 other than forming the preceding step loop.

In the image formation, the image formation operation is conducted as following. Convey the sheet S; hit the front edge of the sheet S to the registration rollers 34; stop the loop rollers 33 after forming the loop between the registration rollers 34 and the loop rollers 33; further form a preceding step loop between the loop rollers 33 and the loop rollers 33A as continuing rotation of the loop rollers 33A; and stop rotation of the loop rollers 33A when a predetermined preceding step loop is formed. The preceding step loop formation in the upstream of the movable conveying unit 100 is conducted by a well-known method, which is the same method employed when forming the loop right in the upstream of the registration rollers 34. Namely, the preceding step loop is formed by stopping the loop rollers 33A after having been rotated for a predetermined time period from the point of time when stopping the loop rollers 33.

After the preceding step loop formation, the vertical misalignment, the lateral misalignment and the inclination are detected and calculated. The arithmetic control unit 120 controls the movable conveying unit 100 and corrects the misalignments.

Figure 14:
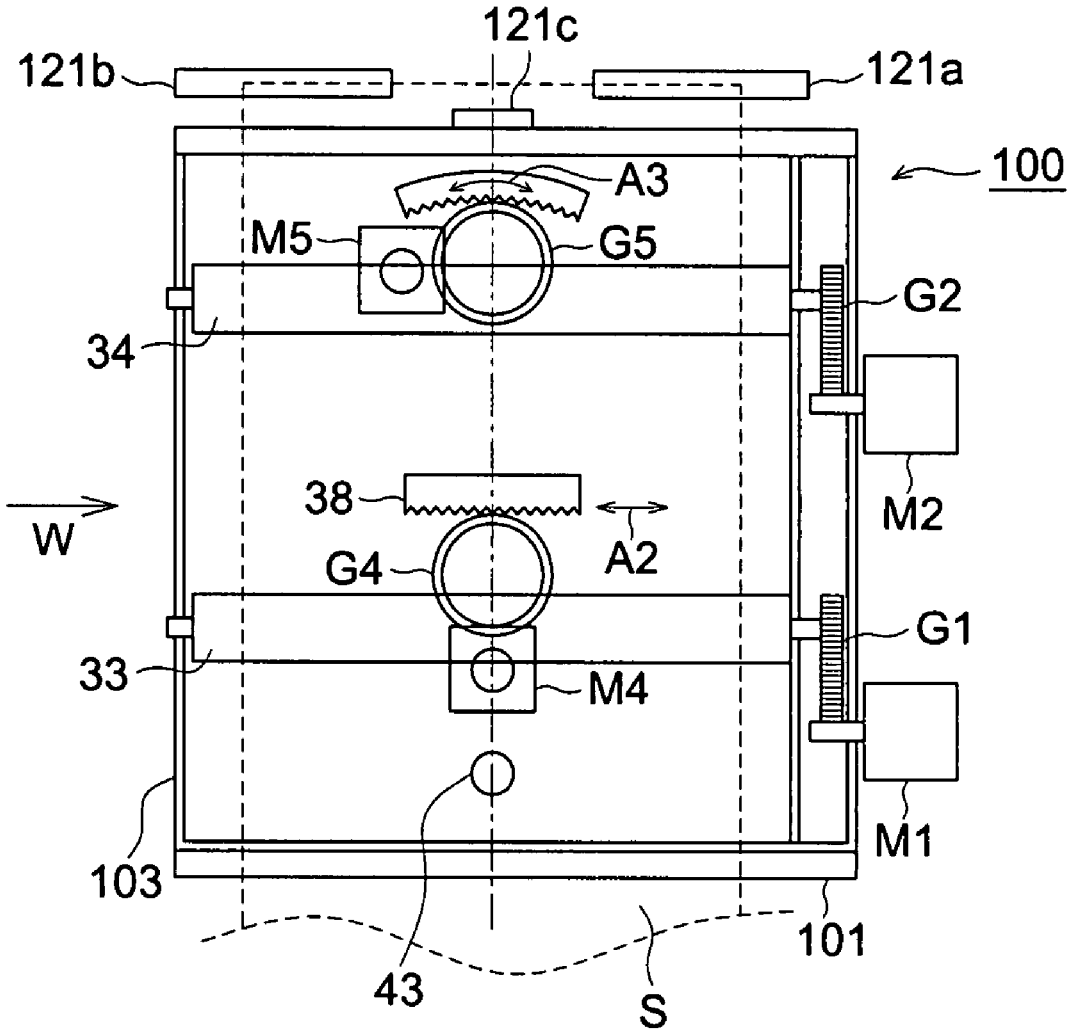
FIG. 14 illustrates a plan view of the movable conveying unit.
Figure 15:
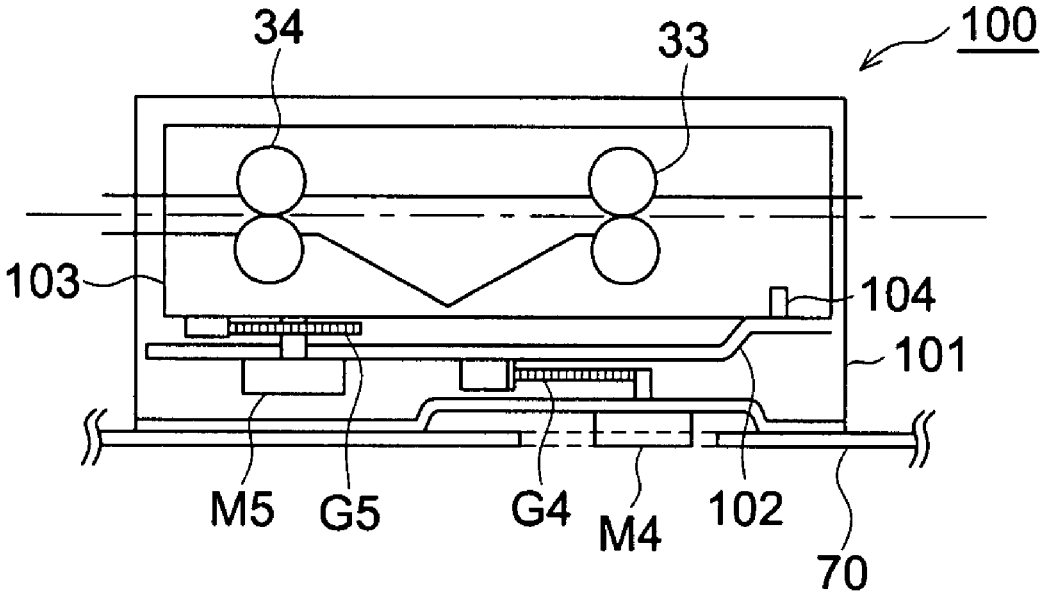
FIG. 15 illustrates a cross sectional view of a movable conveyance unit 100 viewed from the W-direction in FIG. 13.
Figure 16:
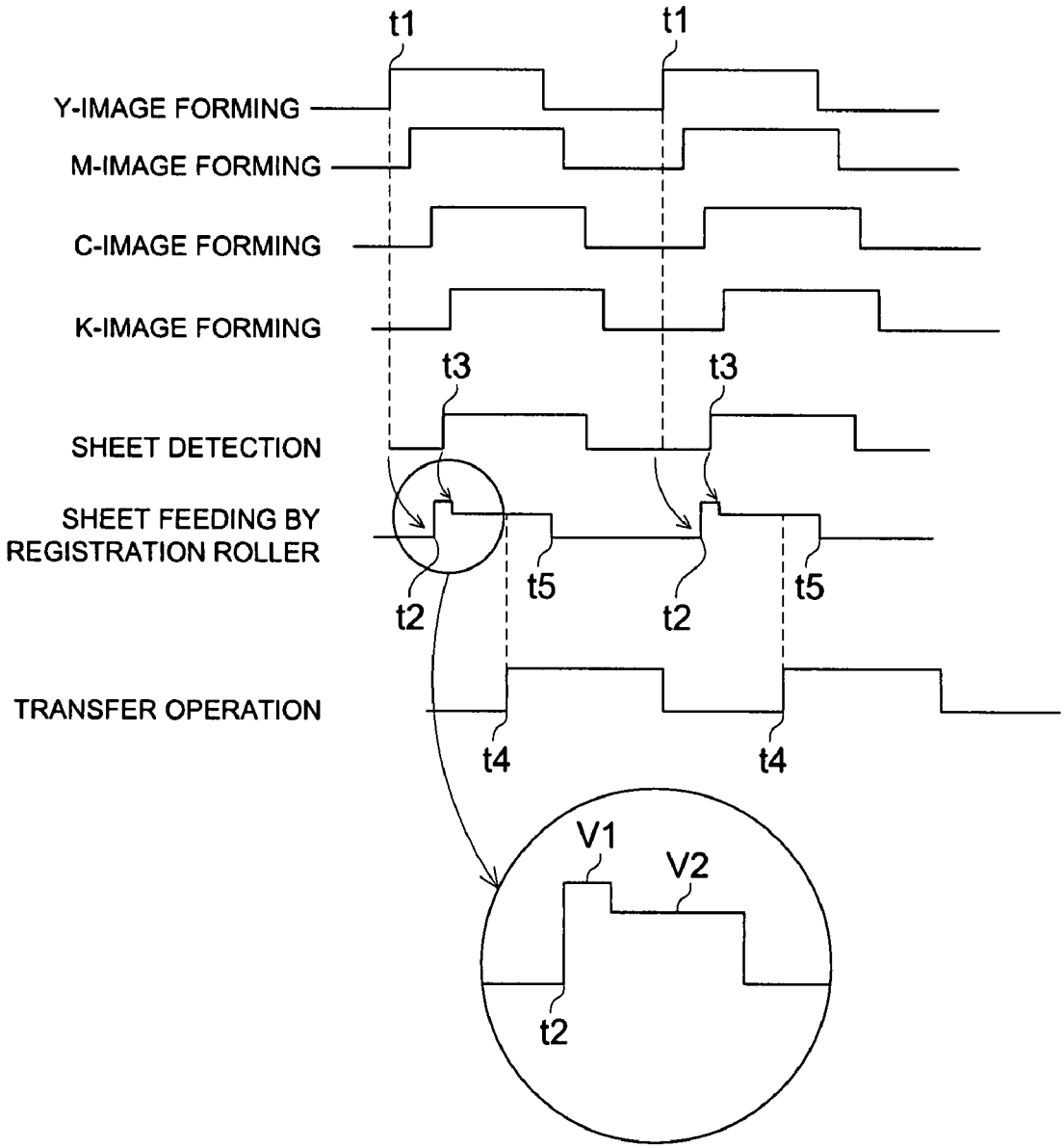
FIG. 16 illustrates a timing chart of the image forming apparatus.

FIGS. 14-16 illustrate other examples of a sheet conveyance apparatus related to an embodiment of the present invention. FIG. 14 illustrates a plan view of the movable conveying unit. FIG. 15 illustrates a cross sectional view of a movable conveying unit 100 viewed from the W-direction in FIG. 14.

In this example, the same as the example shown in FIG. 13, corrections of the misalignments are executed by forming the preceding step loop; detecting the vertical misalignment, the lateral misalignment and the inclination; correcting the lateral misalignment and the inclination by executing the displacement control of the movable conveying unit 100; and correcting the vertical misalignment by controlling the conveyance velocity of the registration roller 34.

This example does not have a mechanism for moving the frame 101 in the direction shown by the arrow A1 in FIG. 2. Namely, this example does not have the motor M3, the gear G3 or rack 105 shown in FIGS. 2-3.

The motors M4 and M5, as described by using FIGS. 2-3 and FIGS. 9-11, conduct the correction of the lateral misalignment and the inclination.

FIG. 16 illustrates a timing chart of the image forming process of this example.

The exposing apparatus 3 of the image forming units Y, M, C and K forms a Y image, a M image, C image and a K image.

Based on the Y image formation start signal, the registration rollers 34 are activated to convey a sheet at the point of time t2 when a predetermined time period has passed from the time t1, which is the time when the Y image forming starts.

At the point of time t3, which is just after starting conveyance, the line sensors 121*a* and 121*b* detect the front edge of the sheet and misalignment correction is conducted based on the detected signals.

The lateral misalignment correction and the inclination correction are executed as described above. The vertical misalignment correction is executed by adjusting the conveyance velocity of the registration rollers 34. Namely, the vertical misalignment correction is executed by changing the conveyance velocity from V1 to V2.

Transfer starts at the point of time t4 when the front edge of the image has reached to the transfer position. The transfer is conducted under the state attained by the misalignment correction described above such that position of the front edge of the image coincides with the sheet front edge.

At the point of time t5, which is after the point of time t4 when the sheet front edge has reached to the transfer position, the registration rollers 34 stops. Since the registration rollers 34 includes a one-way clutch, registration rollers 34 rotates by being pulled in the conveyance direction even after the drive stops, namely the drive of the registration rollers 34 stops after the sheet front edge has reached to the transfer position and the sheet is conveyed by the conveyance force of the transfer roller 8 and an intermediate transfer support roller 7*a* (refer to FIG. 1), which contacts with the transfer roller 8 with pressure.

Embodiments described above are image forming apparatuses having a system for determining a conveyance timing of sheet based on an image formation start signal (an exposing start signal). This invention can be applied to an image forming apparatus having a sequence control for determining the image formation start timing based on sheet conveyance.

This sequence control will be described by using FIG. 5.

Since the sheet inclination is corrected by using formula (1), namely $\theta=\tan^{-1}((Tse\mathbf{1}-Tse\mathbf{2})V/HS)$, the position in the conveyance direction of the front edge position of sheet Sb can be calculated.

Thus, the timing, at which the front edge of the sheet Sb passes through the positions of the line sensors 121*a* and 121*b*, can be calculated. The image formation, where the sheet front edge coincide with the image front edge, is conducted by starting image formation (exposing) at the point of time, which is determined by adding a predetermined time period to the calculated passage timing of the sheet Sb passing trough the sensors 121*a* and 121*b*.

In the image forming apparatus, which synchronizes image formation to the sheet conveyance timing, vertical misalignment is corrected by the control of an image forming start signal.

Figure 17:
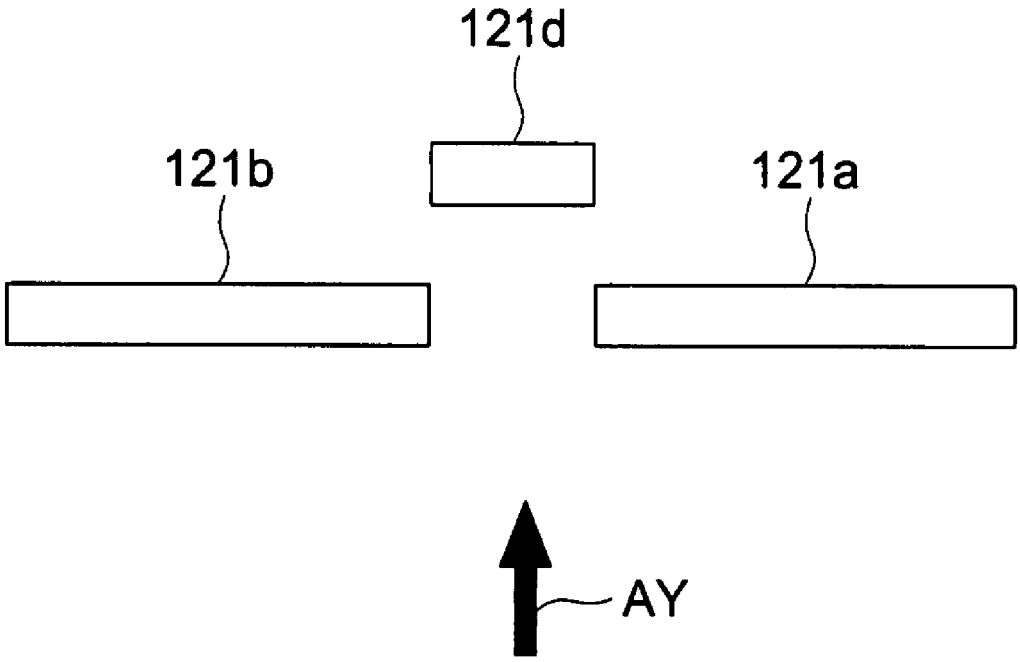
FIG. 17 illustrates a disposition of a line sensor and a front edge sensor.

As shown in FIG. 17, it is also possible to provide a front edge sensor 121*d* for detecting sheet front edge right in the down stream of the line sensors 121*a* and 121*b* to detect the front edge of the sheet S, to which inclination correction has been applied, and to conduct the image formation start based on the detected signal of the front edge sensor 121*d*. Based on this operation, an image position in the sub-scanning direction can be determined with high accuracy.

Since the misalignment caused in the sheet conveyance can be well corrected by an embodiment of this invention, it becomes possible to form an image at a predetermined position on sheet with high accuracy and to realize an image forming apparatus, which is capable of forming a high quality image with a high speed.

Since the movable conveying unit for conveying sheet to a transfer position is initialized every time when forming an image, accuracy of misalignment correction is kept with a constant level and a stable conveyance control is conducted.

While the preferred embodiments of the present invention have been described using specific terms, such description is for illustrative purposes only, and it is to be understood that changes and variations may be made without departing from the sprit or scope of the appended claims.

What is claimed is:

1. An image forming apparatus comprising:

an image carrier;

an image forming section to form an image on the image carrier;

a transfer section to transfer the image carried by the image carrier onto a recording sheet;

a sheet conveying section which conveys the recording sheet fed from a sheet feeding section toward a transfer position with controlled timing, the sheet conveying section comprising:

a pair of registration rollers;

a pair of loop rollers being disposed upstream of the registration rollers in a sheet feeding direction wherein the pair of loop rollers rotates during a prescribed period to make a front edge of the recording sheet hit a nip portion of the pair of registration rollers being stopped to form a curve of the recording sheet and align the front edge to the nip portion; and a detection section which detects the recording sheet having passed through the sheet conveying section; and a movable conveying unit configured to move, based on a sheet detection signal of the detection section, the pair of registration rollers and the pair of loop rollers as a unified body when correcting at least a lateral misalignment of the recording sheet, which is a misalignment in a vertical direction to the sheet feeding direction, and inclination of the recording sheet, before the transfer section transfers the image onto the recording sheet.

2. The image forming apparatus of claim 1, wherein the movable conveying unit comprises a first frame which holds the pair of registration rollers and the pair of loop rollers as integrated in a unified body.

3. The image forming apparatus of claim 2, wherein the pair of registration rollers and the pair of loop rollers move in the sheet feeding direction as a unified body when correcting a vertical misalignment, which is a misalignment in the sheet feeding direction, of the recording sheet.

4. The image forming apparatus of claim 3, further comprising a third drive section which moves the pair of registration rollers and the pair of loop rollers in the sheet feeding direction.

5. The image forming apparatus of claim 2, further comprising a first drive section which moves the pair of registration rollers and the pair of loop rollers in a direction vertical to the sheet feeding direction.

6. The image forming apparatus of claim 2, further comprising a second drive section which rotates the pair of registration rollers and the pair of loop rollers on an axis, which is approximately perpendicular to a sheet conveyance surface.

7. The image forming apparatus of claim 2, further comprising a second frame which holds the pair of registration rollers and the pair of loop rollers such that the pair of registration rollers and the pair of loop rollers are rotatable on a rotation axis which being approximately perpendicular to a sheet conveyance surface.

8. The image forming apparatus of claim 7, further comprising a third frame which holds the second frame such that the second frame is movable in a direction vertical to the sheet feeding direction.

9. The image forming apparatus of claim 8, wherein the third frame is movable in the sheet feeding direction.

10. The image forming apparatus of claim 1, further comprising:

a pair of sheet conveying rollers provided upstream of the movable conveying unit in the sheet conveying direction; and a releasing device which releases a nip of the pair of sheet conveying rollers during a period when a misalignment of the sheet is corrected by the movable conveying unit.

11. The image forming apparatus of claim 1, further comprising a loop forming section which forms a preliminary loop of the sheet at upstream of the movable conveying unit in the sheet conveying direction.

12. The image forming apparatus of claim 1, further comprising a sheet re-feeding section which reverses front-back faces of the recording sheet, on one surface of which an image has been formed, and conveys the recording sheet reversed toward the transfer position, wherein the sheet conveying apparatus conveys the recording sheet from the sheet re-feeding section toward the transfer position.

13. The image forming apparatus of claim 1, further comprising:

a controller which controls timing of conveying the recording sheet toward the transfer position; and wherein the controller calculates vertical misalignment of the recording sheet, lateral misalignment of the recording sheet and inclination of the recording sheet based on a sheet detection signal of the detection section, and corrects at least the lateral misalignment and the inclination by controlling the movable conveying unit, where the vertical misalignment is a misalignment in the sheet feeding direction, and the lateral misalignment is a misalignments in a vertical direction to the sheet feeding direction.

14. The image forming apparatus of claim 13, wherein the controller controls the movable conveying unit to correct the vertical misalignment.

15. The image forming apparatus of claim 13, wherein the controller controls sheet conveying speed of the registration rollers to correct the vertical misalignment.

16. The image forming apparatus of claim 13, wherein the image forming section comprises plural image forming units, wherein, the controller synchronizes rotation of the registration rollers with an image formation start signal of an image forming unit arranged at farthest position from the transfer position among the plural image forming units.

17. The image forming apparatus of claim 13, wherein the detection section comprises line sensors which detect both side edges of the recording sheet at both ends in the vertical direction to the sheet feeding direction.

18. The image forming apparatus of claim 13, wherein the sheet conveying apparatus conveys the recording sheet with a reference of centerline in a sheet width vertical to the sheet feeding direction, and the controller calculates the lateral misalignment as a center position misalignment of the recording sheet in the vertical direction to the sheet feeding direction.

19. The image forming apparatus of claim 13, wherein the sheet conveying apparatus conveys the recording sheet with one-side reference in a sheet width vertical to the sheet feeding direction, and the controller calculates the lateral misalignment as a one-side edge misalignment of the recording sheet in the vertical direction to the sheet feeding direction.

20. The image forming apparatus of claim 13, wherein the controller initializes the movable conveying unit every time of formation of one frame image.

21. The image forming apparatus of claim 13, wherein in cases of dual surface image formation, the controller initializes the movable conveying unit every time of front surface image formation and every time of rear surface image formation.

22. The image forming apparatus of claim 20, wherein the movable conveying unit comprises plural frames to hold registration rollers and the loop rollers, the plural frames being changeable in position or in angle, wherein when the controller initializes the movable conveying unit the plural frames are set to an initial position or to an initial angle.

23. The image forming apparatus of claim 20, wherein the sheet conveying apparatus comprises a stepping motor to correct a misalignment of the sheet, wherein the initialization is executed by driving the step motor in an opposite direction, with pulse numbers which the stepping motor has been driven with when correcting the misalignment.

24. The image forming apparatus of claim 20, wherein the sheet conveying apparatus comprises a home position sensor to detect a home position of one of the plural frames, wherein the initialization is executed based on an output of the home position sensor.

* * * * *